US010659882B2

(12) United States Patent
Yang et al.

(10) Patent No.: US 10,659,882 B2
(45) Date of Patent: May 19, 2020

(54) DIAPHRAGM FOR PRODUCING SOUND AND SPEAKER USING SAME

(71) Applicant: AAC Technologies Pte. Ltd., Singapore (SG)

(72) Inventors: Binbin Yang, Shenzhen (CN); Bin Zhao, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 0 days.

(21) Appl. No.: 16/427,025

(22) Filed: May 30, 2019

(65) Prior Publication Data

US 2019/0373369 A1 Dec. 5, 2019

(30) Foreign Application Priority Data

Jun. 1, 2018 (CN) ..... 2018 2 0848709 U

(51) Int. Cl.

| | |
|---|---|
| ***H04R 7/18*** | (2006.01) |
| ***H04R 7/12*** | (2006.01) |
| ***H04R 9/02*** | (2006.01) |
| ***H04R 9/06*** | (2006.01) |
| ***H04R 7/20*** | (2006.01) |

(52) U.S. Cl.

CPC ..... *H04R 7/18* (2013.01); *H04R 7/122* (2013.01); *H04R 7/127* (2013.01); *H04R 7/20* (2013.01); *H04R 9/025* (2013.01); *H04R 9/06* (2013.01); *H04R 2231/003* (2013.01); *H04R 2307/207* (2013.01); *H04R 2400/11* (2013.01)

(58) Field of Classification Search

CPC ..... H04R 7/122; H04R 7/127; H04R 7/18; H04R 7/20; H04R 9/025; H04R 9/06; H04R 2231/003; H04R 2307/207; H04R 2400/11

USPC ..... 381/398, 403, 405, 423, 424, 430; 181/171, 172

See application file for complete search history.

(56) References Cited

U.S. PATENT DOCUMENTS

| | | | | |
|---|---|---|---|---|
| 8,995,704 | B2 * | 3/2015 | Huang | H04R 9/043 181/171 |
| 2016/0014522 | A1 * | 1/2016 | Matsumura | H04R 7/18 381/398 |
| 2016/0173990 | A1 * | 6/2016 | Park | H04R 1/06 |

* cited by examiner

*Primary Examiner* — Huyen D Le
(74) *Attorney, Agent, or Firm* — IPro, PLLC; Na Xu

(57) ABSTRACT

The present disclosure discloses a diaphragm for radiating sound, including: a dome; a suspension surrounding the dome, including a first connecting portion adjacent to the dome and having a first surface and a second surface, a suspending portion extending from and surrounding the first connecting portion, and a second connecting portion extending from and surrounding the suspending portion. The suspending portion includes a convex part along a direction from the second surface to the first surface, an inner edge connecting to the first connecting portion, and an outer edge connecting to the second connecting portion. The diaphragm further includes a stiffening layer located on the first surface of the first connecting portion, extending from the inner edge toward the dome. The present disclosure further includes a speaker incorporating the diaphragm.

7 Claims, 3 Drawing Sheets

DIAPHRAGM FOR PRODUCING SOUND AND SPEAKER USING SAME

FIELD OF THE PRESENT DISCLOSURE

The present disclosure relates to the field of electromagnetic transducers, more particularly to a speaker and a diaphragm used in the speaker.

DESCRIPTION OF RELATED ART

A speaker is a very important component equipped in a mobile phone for producing audible sounds. A speaker generally uses a diaphragm to produce vibration and further to generate sounds. The diaphragm is a key factor to determine the performance of the speaker. The diaphragm is generally provided with pleats for enhancing the strength of the diaphragm and further for solving problems caused by distortion of the diaphragm during vibration. In some cases, the pleats are arranged at corners of the diaphragm.

In a related speaker, a diaphragm includes a dome and a suspension surrounding the dome. The suspension includes a concave portion, and the pleats are arranged in the concave portion. However, the pleats in a concave portion will fold the diaphragm and the strength of the diaphragm is weakened, which will cause distortion and badly affect the performance of the speaker.

Therefore, an improved diaphragm and a speaker having such a diaphragm are desired.

SUMMARY OF THE PRESENT DISCLOSURE

One of the primary objects of the present disclosure is to provide a diaphragm with improved stiffness for avoiding distortion.

Accordingly, the present disclosure provides a diaphragm for radiating sound, including: a dome; a suspension surrounding the dome, including a first connecting portion adjacent to the dome and having a first surface and a second surface, a suspending portion extending from and surrounding the first connecting portion, and a second connecting portion extending from and surrounding the suspending portion. The suspending portion includes a convex part along a direction from the second surface to the first surface, an inner edge connecting to the first connecting portion, and an outer edge connecting to the second connecting portion. The diaphragm further includes a stiffening layer located on the first surface of the first connecting portion, extending from the inner edge toward the dome.

Further, the stiffening layer extends toward the suspending portion.

Further, the stiffening layer is made by glue or liquid silica.

Further, the dome is integrally with the suspension.

Further, the inner edge and the outer edge are both rectangles with rounded corners.

Further, the suspension further includes a plurality of pleats arranged on corners thereof, and the pleats extend from the inner edge toward the outer edge radially.

Further, the pleats extends from an edge of the stiffening layer toward the outer edge of the suspending portion.

Further, the pleats are recessed along a direction from the first surface toward the second surface.

The present disclosure further provides a speaker incorporating the diaphragm mentioned above.

BRIEF DESCRIPTION OF THE DRAWINGS

Many aspects of the exemplary embodiments can be better understood with reference to the following drawings.

The components in the drawing are not necessarily drawn to scale, the emphasis instead being placed upon clearly illustrating the principles of the present disclosure.

DETAILED DESCRIPTION OF THE EXEMPLARY EMBODIMENTS

Figure 1:
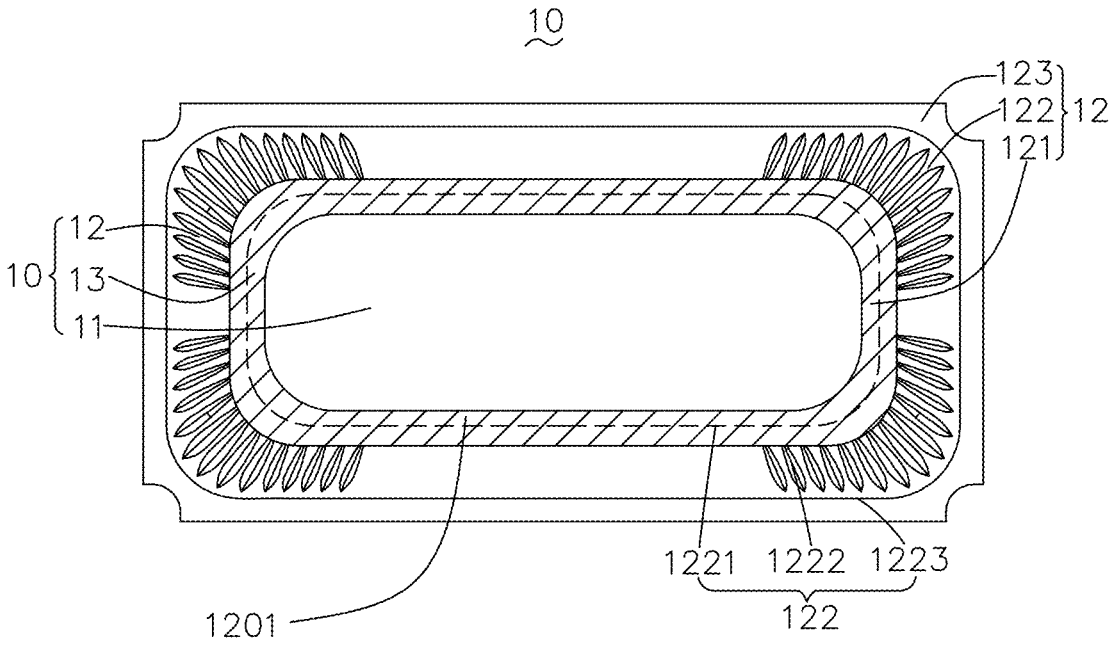
FIG. 1 is an illustrative top view of a diaphragm in accordance with an exemplary embodiment of the present disclosure.
Figure 2:
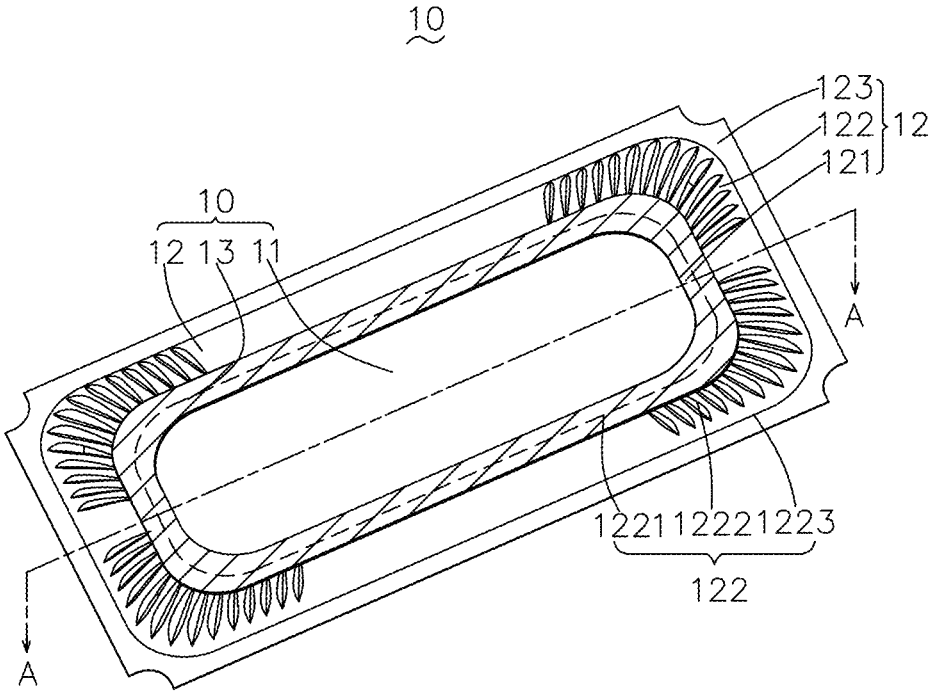
FIG. 2 is an illustrative isometric view of the diaphragm in FIG. 1.
Figure 3:
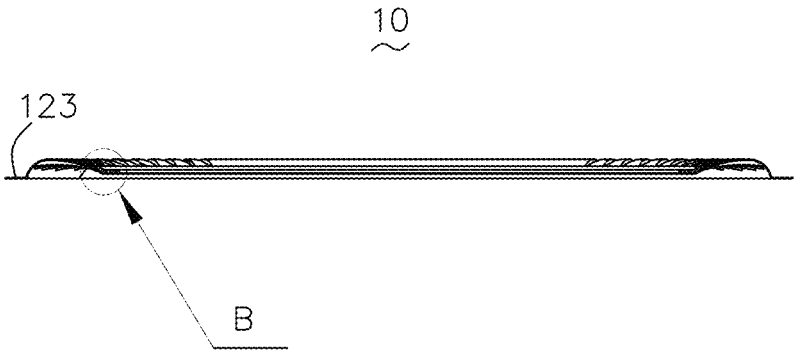
FIG. 3 is a cross-sectional view of the diaphragm taken along line A-A in FIG. 2.
Figure 4:
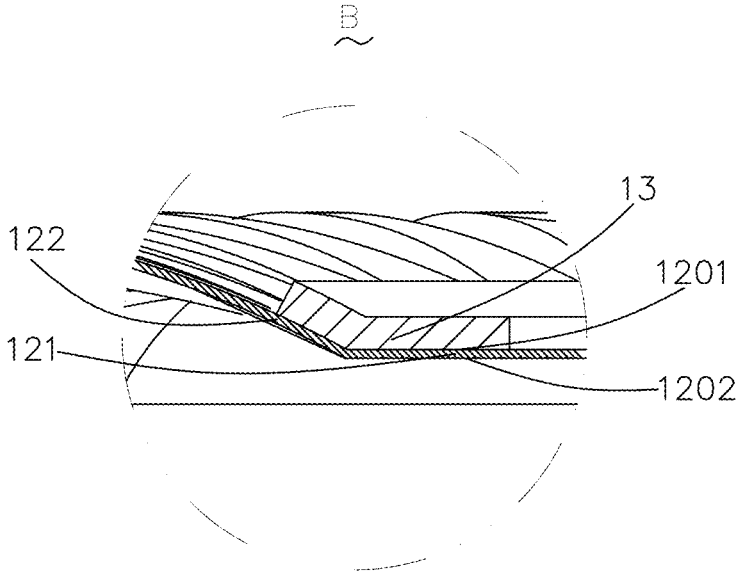
FIG. 4 is an enlarged view of Part B in FIG. 3.

The present disclosure will hereinafter be described in detail with reference to exemplary embodiments. To make the technical problems to be solved, technical solutions and beneficial effects of the present disclosure more apparent, the present disclosure is described in further detail together with the figure and the embodiments. It should be understood the specific embodiments described hereby is only to explain the disclosure, not intended to limit the disclosure.

Embodiment 1

Referring to FIGS. 1-4, a diaphragm 10 in accordance with an exemplary embodiment of the present disclosure includes a dome 11 and a suspension 12 surrounding the dome 11. The suspension 12 includes a first connecting portion 121 adjacent to the dome 11, a suspending portion 122 extending from and surrounding the first connecting portion 121, and a second connecting portion 123 extending from and surrounding the suspending portion 122. The first connecting portion 121 includes a first surface 1201 and a second surface 1202 opposite to the first surface 1201. In the embodiment, the first surface 1201 is an upper surface, and the second surface is a lower surface. The suspending portion 122 includes a convex portion along a direction from the second surface 1202 to the first surface 1201. The suspending portion further includes an inner edge 1221 connecting the first connecting portion 121, and an outer edge 1223 connecting the second connecting portion 123. Optionally, both of the inner and outer edges are rectangles with rounded corners. The first connecting portion 121 includes a stiffening layer 13 coupled with the first surface 1201. The stiffening layer 13 extends from the inner edge 1221 of the suspending portion 122 toward the dome 11. Optionally, the stiffening layer 13 also extends toward the suspending portion 122. The stiffening layer 13 is arranged on selected place where the stress concentrates. In FIGS. 1-4, the place is marked with left slashes. The stiffening layer 13 includes a layer of glue. In the embodiment, the inner edge 1221 is covered by the stiffening layer 13. For clearly describing the structure, in FIGS. 2-3, the inner edge is illustrated by a dotted line. The suspending portion 122 further includes a plurality of pleats 1222 arranged on corners thereof. The pleats 1222 extend from the inner edge 1221 toward the outer edge 1223 radially, and symmetrically locates on corners. The pleats 1222 are recessed along a direction from the first surface 1201 toward the second surface 1202.

In the embodiment, the pleats 1222 extend from an edge of the stiffening layer 13 toward the outer edge 1223 of the suspending portion 122. The stiffening layer 13 is made of glue or liquid silica, which means that the stiffening layer 13 can be made by smearing glue onto the diaphragm. By virtue of the stiffening layer 13, the stress inside the diaphragm is released, and the vibration of the diaphragm is balanced. Acoustic performance is accordingly improved.

Embodiment 2

Figure 5:
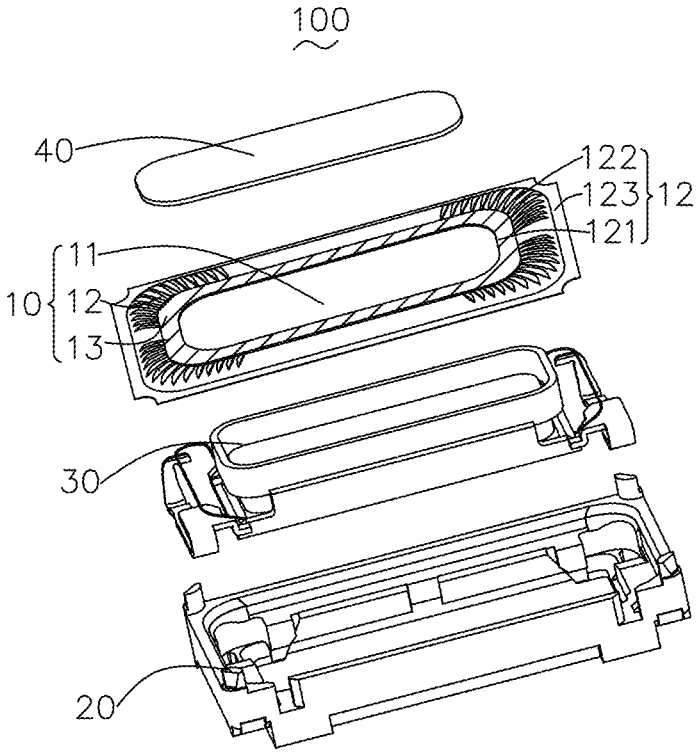
FIG. 5 is an isometric and exploded view of a speaker using the diaphragm in FIG. 1.

Referring to FIG. 5, the present disclosure also provides a speaker 100 having a frame 20 with a receiving space, a magnetic circuit system 30 received in the receiving space, and a vibration system. The vibration system includes a diaphragm 10 located above the frame 20. The diaphragm 10 includes a dome 11 and a suspension 12 surrounding the dome 11. The suspension 12 includes a first connecting portion 121 adjacent to the dome 11, a suspending portion 122 extending from and surrounding the first connecting portion 121, and a second connecting portion 123 extending from and surrounding the suspending portion 122. The first connecting portion 121 includes a first surface 1201 and a second surface 1202 opposite to the first surface 1201. In the embodiment, the first surface 1201 is an upper surface, and the second surface is a lower surface. The suspending portion 122 includes a convex portion along a direction from the second surface 1202 to the first surface 1201. The suspending portion further includes an inner edge 1221 connecting the first connecting portion 121, and an outer edge 1223 connecting the second connecting portion 123. Optionally, both of the inner and outer edges are rectangles with rounded corners. The first connecting portion 121 includes a stiffening layer 13 coupled with the first surface 1201. The stiffening layer 13 extends from the inner edge 1221 of the suspending portion 122 toward the dome 11. Optionally, the stiffening layer 13 also extends toward the suspending portion 122. The stiffening layer 13 is arranged on selected place where the stress concentrates.

In the embodiment, the vibration system further includes a stiffening plate 40 located on a surface of the dome 11 away from the frame 20. An outline of a projection of the stiffening plate 40 along a vibration direction of the diaphragm keeps a distance from an outline of a projection of the stiffening layer 13 along the vibration direction.

Further, the diaphragm 10 includes four notches corresponding to the shape of the frame 20. These notches locates at four corners of the second connecting portions.

The present disclosure provides a diaphragm having a stiffening layer made of glue or liquid silica, which means that the stiffening layer can be made by smearing glue onto the diaphragm. By virtue of the stiffening layer, the stress inside the diaphragm is released, and the vibration of the diaphragm is balanced. Acoustic performance is accordingly improved.

It is to be understood, however, that even though numerous characteristics and advantages of the present exemplary embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A diaphragm for radiating sound, comprising:

a dome;

a suspension surrounding the dome, including a first connecting portion adjacent to the dome and having a first surface and a second surface, a suspending portion extending from and surrounding the first connecting portion, and a second connecting portion extending from and surrounding the suspending portion; wherein the suspending portion includes a convex part along a direction from the second surface to the first surface, an inner edge connecting to the first connecting portion, and an outer edge connecting to the second connecting portion; and wherein the diaphragm further includes a stiffening layer located on the first surface of the first connecting portion, extending from the inner edge toward the dome and extending toward the suspending portion;

the suspension further includes a plurality of pleats arranged on corners thereof, and the pleats extend from the inner edge toward the outer edge radially, wherein the pleats extends from an edge of the stiffening layer toward the outer edge of the suspending portion.

2. The diaphragm as described in claim 1, wherein the stiffening layer is made by glue or liquid silica.

3. The diaphragm as described in claim 1, wherein the dome is integrally with the suspension.

4. The diaphragm as described in claim 1, wherein the inner edge and the outer edge are both rectangles with rounded corners.

5. The diaphragm as described in claim 1, wherein the pleats are recessed along a direction from the first surface toward the second surface.

6. A speaker, comprising:

a frame with a receiving space;

a magnetic circuit system received in the receiving space;

a vibration system including a diaphragm located above the frame; the diaphragm including a dome and a suspension surrounding the dome and having a first connecting portion adjacent to the dome, a suspending portion extending from and surrounding the first connecting portion, and a second connecting portion extending from and surrounding the suspending portion for connecting with the frame; wherein the first connecting portion having a first surface and a second surface;

the suspending portion further includes an inner edge connecting the first connecting portion, and an outer edge connecting the second connecting portion; and the first connecting portion includes a stiffening layer coupled with the first surface; the stiffening layer extending from the inner edge toward the dome and extending toward the suspending portion;

the suspension further includes a plurality of pleats arranged on corners thereof, and the pleats extend from the inner edge toward the outer edge radially, wherein the pleats extends from an edge of the stiffening layer toward the outer edge of the suspending portion.

7. The speaker as described in claim 6, wherein both of the inner and outer edges are rectangles with rounded corners.

* * * * *